US006890209B2

(12) United States Patent
Sawada et al.

(10) Patent No.: US 6,890,209 B2
(45) Date of Patent: May 10, 2005

(54) PRESSURE WELDING TERMINAL FOR PLATE CONNECTOR

(75) Inventors: Yoshitsugu Sawada, Shizuoka (JP); Takuya Hasegawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 111 days.

(21) Appl. No.: 09/950,713

(22) Filed: Sep. 13, 2001

(65) Prior Publication Data

US 2002/0030084 A1 Mar. 14, 2002

(30) Foreign Application Priority Data

Sep. 13, 2000 (JP) ..... 2000-277984

(51) Int. Cl.[7] ..... H01R 4/26

(52) U.S. Cl. ..... 439/404; 439/399; 439/855; 439/701; 439/76.2

(58) Field of Search ..... 439/401, 404, 439/399, 855, 881, 252, 701, 949, 16.2

(56) References Cited

U.S. PATENT DOCUMENTS 5,030,132 A * 7/1991 Hayes et al. ..... 439/397
5,057,026 A * 10/1991 Sawai et al. ..... 439/76.2
5,729,436 A * 3/1998 Yoshigi et al. ..... 361/752
6,494,722 B1 * 12/2002 Sakamoto et al. ..... 439/76.2
6,503,095 B1 * 1/2003 Endo et al. ..... 439/397

* cited by examiner

*Primary Examiner*—Hien Vu
(74) *Attorney, Agent, or Firm*—Armstrong, Kratz, Quintos, Hanson & Brooks, LLP

(57) ABSTRACT

A pressure welding terminal for a plate connector is provided, wherein electrically contacting portions mounted at the same position on respective tabular insulative bodies stacked up are securely electrically connected to each other. A JB-applied pressure welding terminal 50 as the pressure welding terminal for the plate connector is mounted on a pressure welding plate as the tabular insulative body. The pressure welding plates are stacked up to form the plate connector. The JB-applied pressure welding terminal 50 has a wire connecting portion 51 to which an electric wire 4 is pressure-welded, an electrically contacting portion 52, and a slit portion 59. The wire connecting portion 51 has a placing wall 55 and a pair of sidewalls 56*a*, 56*b*. The electrically contacting portion 52 is formed tubularly, and a conductive connection bar is inserted therein. The slit portion 59 is cut out on the wire connecting portion 51 and extends from a connecting portion R of the wire connecting portion 51 and the electrically contacting portion 52 to the sidewall 56*b*. The electrically contacting portion 52 is capable of shifting with respect to the wire connecting portion 51 by means of the slit portion 59 in directions H1,H2.

4 Claims, 7 Drawing Sheets

PRESSURE WELDING TERMINAL FOR PLATE CONNECTOR

BACKGROUND OF THE INVENTION

1. Field of the Invention

The present invention relates to a pressure welding terminal for a plate connector, wherein a wire connecting portion to be pressure-weld with an electric wire and an electrically contacting portion to be connected to another terminal metal fitting is arranged in a L-shape.

2. Description of the Related Art

A wiring harness installed to a motor vehicle is generally consists of sub-harnesses for respective electronic equipment. Therefore, the connection between the above sub-harnesses are complex thereby to cause poor assembly workability and poor quality assurance at the worst case.

In order to facilitate the above connection, a plate connector has been suggested, wherein a tabular insulative body and a pressure welding terminal are used and a plurality of tabular insulative bodies are stacked. The tabular insulative body is made of synthetic resin. The tabular insulative body has a flat tabular bottom, partition walls upstanding from the bottom wall, and through holes.

The partition walls are arranged in parallel at uniform intervals. Two opposing partition walls form an electric wire accommodating groove to accommodate an electric wire. The through hole is bored through the bottom wall. The through hole is a hole for the pressure welding terminal placed on the bottom wall.

The pressure welding terminal is formed by bending a metal plate. The pressure welding terminal has a wire connecting portion to be connected to the electric wire and an electrically contacting portion being tubular and being connected with the wire connecting portion. The wire connecting portion has a pair of pressure welding edges facing each other and pressure-welded with the electric wire. A belt-like conductive connection bar is inserted into the electrically contacting portion. In the pressure welding terminal, the wire connecting portion and the electrically contacting portion are arranged in a L-shape.

The insulative body is placed on the bottom wall of the insulative body. On the bottom wall of the tabular insulative body, the pressure welding terminals are arranged in a matrix. The above arranged tabular insulative bodies are stacked up, and the connection bars are inserted into predetermined electrically contacting portions, thereby obtaining the plate connector.

Like this, the pressure welding terminals are arranged at predetermined positions on the bottom wall of the insulative body, the connection bars are inserted into the predetermined electrically contacting portions, and the electric wires are connected according to the predetermined patter.

With respect to the above prior art insulative body, however, dimension errors would become relatively large since the insulative body of the plate connector is molded of synthetic resin by the injection molding, thereby causing mispositioning of the electrically contacting portion and the through hole.

When the electrically contacting portion deviates the through hole, the above connection bar is not easily inserted into the electrically contacting portion and the through hole, thereby causing the connection bar to be bent. And, the above electrically contacting portion and the wire connecting portion would be separated.

SUMMARY OF THE INVENTION

An object of the present invention is to provide a pressure welding terminal for a plate connector, wherein the electrically contacting portions mounted at the same position on the tabular insulative bodies stacked up can be securely electrically connected to each other.

In order to achieve the above object, as a first aspect of the present invention, a pressure welding terminal for a plate connector, which pressure welding terminal is mounted on a tabular insulative body, comprises: a wire connecting portion having a pair of walls making an electric wire be placed therebetween, the electric wire being pressure-welded to the wire connecting portion; a tubular electrically contacting portion continuing from the wire connecting portion, in which electrically contacting portion an insertion to connect the electrically contacting portion with another terminal metal fitting is inserted; and a slit portion provided on the wire connecting portion and extending from a connecting portion of the wire connecting portion and the electrically contacting portion over one wall of the pair of walls, wherein the wire connecting portion and the electrically contacting portion are arranged in a L-shape, and the electrically contacting portion communicates with a through hole of the tabular insulative body.

As a second aspect of the present invention, based on the first aspect, the slit portion is provided on the wire connecting portion, while extending over the one wall farther from the electrically contacting portion.

As a third aspect of the present invention, based on the second aspect, the wire connecting portion has a placing wall from which the pair of walls extend and on which the electric wire is placed, and the slit portion has a first slit cut out on the placing wall from the connecting portion in a width direction of the placing wall and a second slit cut out on the one wall farther from the electrically contacting portion and continuing from the first slit in a pressure-welding direction of the electric wire to the wire connecting portion.

As a fourth aspect of the present invention, based on the first aspect, the slit portion is provided on the wire connecting portion, while extending over the one wall nearer the electrically contacting portion.

As a fifth aspect of the present invention, based on the fourth aspect, the wire connecting portion has a placing wall from which the pair of walls extend and on which the electric wire is placed, and the slit portion has a third slit cut out on the placing wall from the connecting portion in a longitudinal direction of the electric wire pressure-welded to the wire connecting portion and a fourth slit cut out on the one wall nearer the electrically contacting portion and continuing from the third slit in a pressure-welding direction of the electric wire to the wire connecting portion.

According to the above-described structures of the present invention, the following advantages are provided.

(1) The electrically contacting portion can shift with respect to the wire connecting portion in the axial direction of the electric wire pressure-welded to the wire connecting portion and also in the direction perpendicular to the above axial direction. Therefore, even if the hole of the electrically contacting portion deviates from the through hole, the electrically contacting portion shifts toward the position where the hole agrees with the through hole by the insertion of the connection bar. Accordingly, the connection bar can be easily inserted into the electrically contacting portion.

And, because the electrically contacting portion can shift with respect to the wire connecting portion, an excessive stress in the JB-applied pressure welding terminal can be prevented when the connection bar is inserted into the electrically contacting portion. Therefore, a break of the JB-applied pressure welding terminal at the connecting portion can be prevented.

Therefore, the JB-applied pressure welding terminals in the stacked pressure welding plates enable the stacked electrically contacting portions to be securely electrically connected to each other, thereby ensuring a secure connection of the electrically contacting portions with the electric wires.

(2) Because the slit portion extends over the sidewall located farther from the electrically contacting portion, the electrically contacting portion can securely shift with respect to the wire connecting portion. Therefore, even if the hole of the electrically contacting portion deviates from the through hole, the electrically contacting portion shifts toward the position where the hole agrees with the through hole by the insertion of the connection bar. Accordingly, the connection bar can be easily inserted into the electrically contacting portion.

And, because the electrically contacting portion can shift with respect to the wire connecting portion, an excessive stress in the JB-applied pressure welding terminal can be prevented when the connection bar is inserted into the electrically contacting portion. Therefore, a break of the JB-applied pressure welding terminal at the connecting portion can be prevented.

Therefore, the JB-applied pressure welding terminals in the stacked pressure welding plates enable the stacked electrically contacting portions to be securely electrically connected to each other, thereby ensuring a secure connection of the electrically contacting portions with the electric wires.

(3) The slit portion has a first slit portion and a second slit. The first slit is cut out on the placing wall. The second slit extends from the first slit up to the vertical middle portion of the sidewall farther from the electrically contacting portion. Therefore, the electrically contacting portion can further securely shift with respect to the wire connecting portion. Therefore, even if the hole of the electrically contacting portion deviates from the through hole, the electrically contacting portion shifts toward the position where the hole agrees with the through hole by the insertion of the connection bar. Accordingly, the connection bar can be easily inserted into the electrically contacting portion.

And, because the electrically contacting portion can shift with respect to the wire connecting portion, an excessive stress in the JB-applied pressure welding terminal can be prevented when the connection bar is inserted into the electrically contacting portion. Therefore, a break of the JB-applied pressure welding terminal at the connecting portion can be prevented.

Therefore, the JB-applied pressure welding terminals in the stacked pressure welding plates enable the stacked electrically contacting portions to be securely electrically connected to each other, thereby ensuring a secure connection of the electrically contacting portions with the electric wires.

(4) Because the slit portion extends over the sidewall located nearer the electrically contacting portion, the electrically contacting portion can securely shift with respect to the wire connecting portion. Therefore, even if the hole of the electrically contacting portion deviates from the through hole, the electrically contacting portion shifts toward the position where the hole agrees with the through hole by the insertion of the connection bar. Accordingly, the connection bar can be easily inserted into the electrically contacting portion.

And, because the electrically contacting portion can shift with respect to the wire connecting portion, an excessive stress in the JB-applied pressure welding terminal can be prevented when the connection bar is inserted into the electrically contacting portion. Therefore, a break of the JB-applied pressure welding terminal at the connecting portion can be prevented.

Therefore, the JB-applied pressure welding terminals in the stacked pressure welding plates enable the stacked electrically contacting portions to be securely electrically connected to each other, thereby ensuring a secure connection of the electrically contacting portions with the electric wires.

(5) The slit portion has a third slit portion and a fourth slit. The third slit is cut out on the placing wall. The fourth slit extends from the third slit up to the vertical middle portion of the sidewall nearer the electrically contacting portion. Therefore, the electrically contacting portion can further securely shift with respect to the wire connecting portion. Therefore, even if the hole of the electrically contacting portion deviates from the through hole, the electrically contacting portion shifts toward the position where the hole agrees with the through hole by the insertion of the connection bar. Accordingly, the connection bar can be easily inserted into the electrically contacting portion.

And, because the electrically contacting portion can shift with respect to the wire connecting portion, an excessive stress in the JB-applied pressure welding terminal can be prevented when the connection bar is inserted into the electrically contacting portion. Therefore, a break of the JB-applied pressure welding terminal at the connecting portion can be prevented.

Therefore, the JB-applied pressure welding terminals in the stacked pressure welding plates enable the stacked electrically contacting portions to be securely electrically connected to each other, thereby ensuring a secure connection of the electrically contacting portions with the electric wires.

The above and other objects and features of the present invention will become more apparent from the following description taken in conjunction with the accompanying drawings.

DESCRIPTION OF THE PREFERRED EMBODIMENT(S)

Embodiments of the present invention will now be described in further detail with reference to the accompanying drawings.

Figure 1:
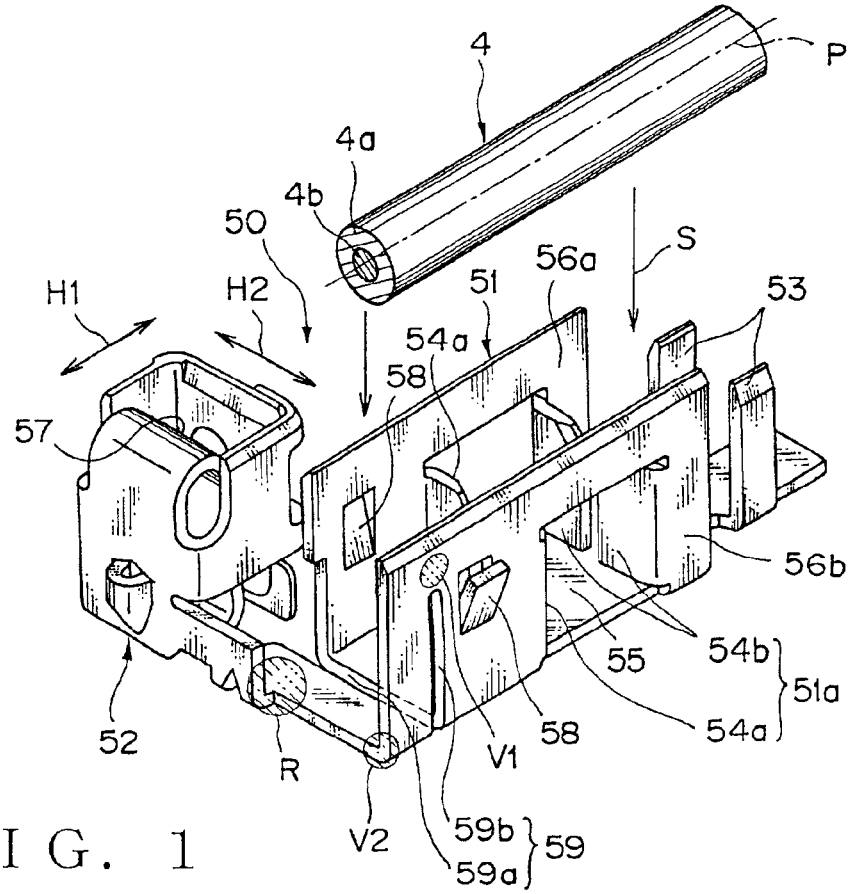
FIG. 1 is a perspective view showing a first embodiment of a JB-applied pressure welding terminal in accordance with the present invention.
Figure 2:
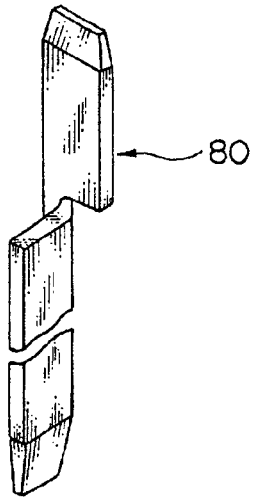
FIG. 2 is a perspective view showing a connection bar inserted into an electrically contacting portion of the JB-applied pressure welding terminal of FIG. 1.
Figure 3:
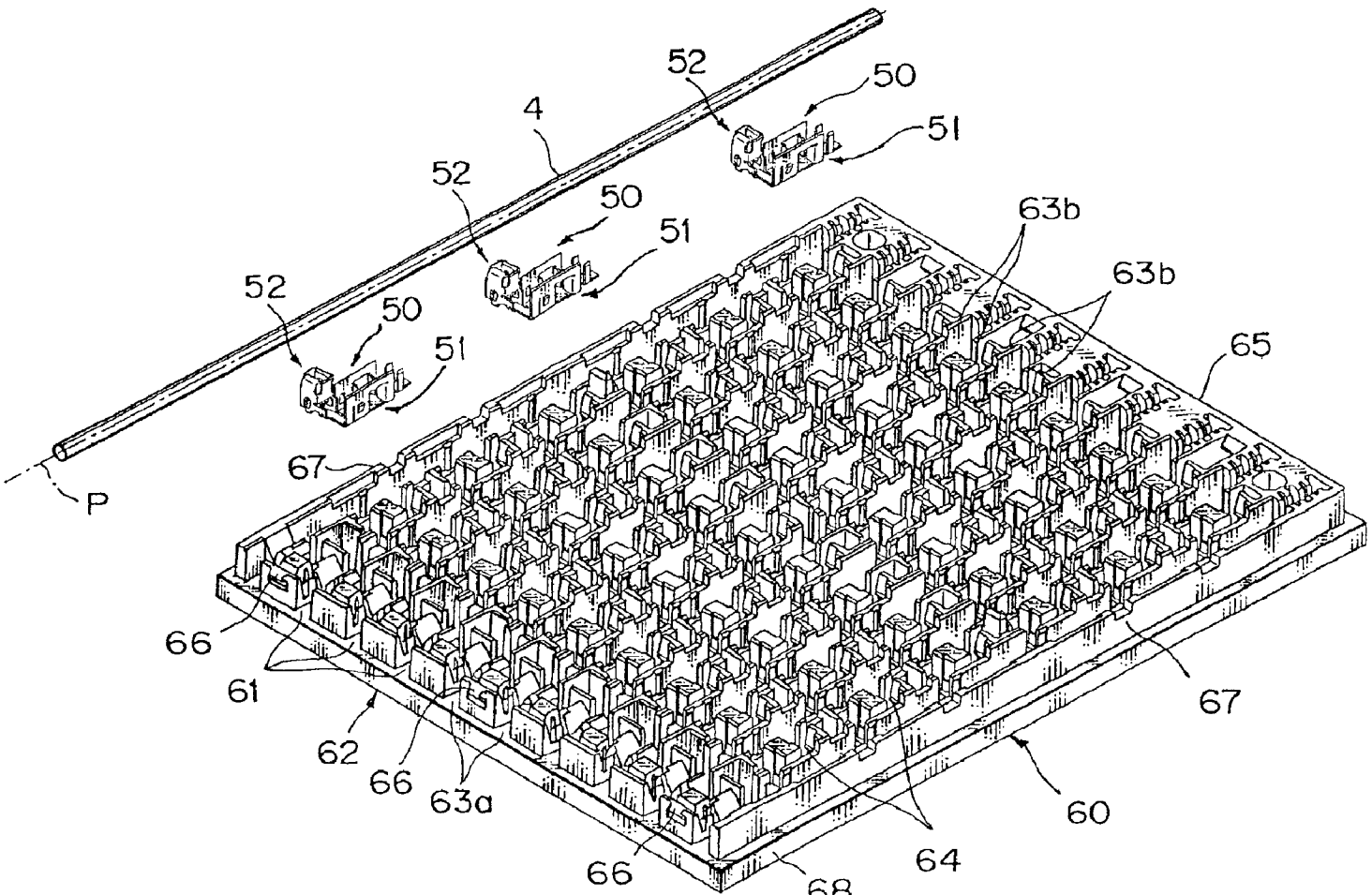
FIG. 3 is a perspective view showing a pressure welding plate on which the JB-applied pressure welding terminal is mounted.

A first embodiment of a pressure welding terminal for a plate connector, i.e., a pressure welding terminal 50 for a junction block (JB), in accordance with the present invention is described by referring to FIG. 1 to FIG. 8. The JB-applied pressure welding terminal 50 as the pressure welding terminal for the plate connector, as shown in FIG. 1, is mounted on a pressure welding plate 60 as a tabular insulative body shown in FIG. 3. And, the pressure welding plates 60 are stacked up to form a laminated plate connector 1 as the plate connector shown in FIG. 5.

Figure 6:
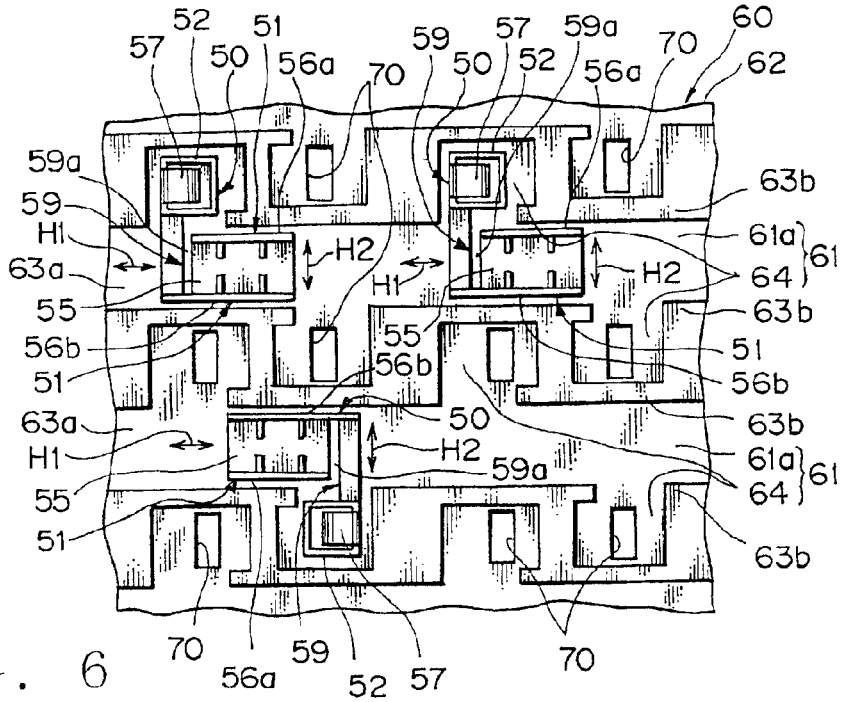
FIG. 6 is a plan view showing a state of the pressure welding plate and the JB-applied pressure welding terminals mounted thereon.

The JB-applied pressure welding terminal 50 is formed by bending a conductive metal plate. The JB-applied pressure welding terminal 50 has a wire connecting portion 51, an electrically contacting portion 52, engaging pieces 58, and a slit portion 59 as shown in FIG. 1 and FIG. 6. The wire connecting portion 51 has a flat placing wall 55 on which an electric wire 4 is placed, a pair of sidewalls 56*a*,56*b*, a pair of cramping pieces 53, and a pressure welding portion 51*a*.

The placing wall 55 is formed rectangularly. A pair of sidewalls 56*a*,56*b* each are formed rectangularly. A pair of sidewalls 56*a*,56*b* each continue upstandingly from respective sides of the placing wall 55 so that they can position the electric wire 4 therebetween. The electric wire 4 is pressure-welded to the pressure welding portion 51*a*.

The cramping portions 53 each stand on the placing wall 55, while continuing from the respective sides of the placing wall 55. The cramping portions 53 are bent and hold the electric wire 4 placed on the placing wall 55.

The pressure welding portion 51*a* has two pairs of opposite pressure welding edges 54*a*,54*b*. The pressure welding edges 54*a*,54*b* each stand on the placing wall 55. The pressure welding edges 54*a*,54*b* each project inwardly from the respective sidewalls 56*a*,56*b*.

The pressure welding edges 54*a*,54*b* cut the sheathing portion 4*a* (FIG. 1) of the electric wire 4 when the electric wire 4 is pressed therein along the arrow S (FIG. 1) and are put into contact with a core wire 4*b* (FIG. 1) so as to attain the electrical connection with the electric wire 4. That is, the pressure welding edges 54*a*,54*b* are pressure-welded with the electric wire 4.

The electrically contacting portion 52 continues to one flange (i.e., sidewall) of the placing wall 55. That is, the electrically contacting portion 52 continues to the wire connecting portion 51. The wire connecting portion 51 and the electrically contacting portion 52 are arranged such that the shape of the JB-applied pressure welding terminal 50 is in a L-shape. A longitudinal axis of the electrically contacting portion 52 is perpendicular to a longitudinal axis P of the electric wire 4.

The electrically contacting portion 52 is formed in a rectangular-tubular shape and is arranged such that its hole communicates with the through hole 70 of the pressure welding plate 60. In the hole of the electrically contacting portion 52, a connection bar 80 (FIG. 2) as an insertion is inserted. And, this connection bar 80 is made of conductive metal rectangularly. In the edge portion of the hole of the electrically contacting portion 52, a connection spring portion 57 to pressure-contact with the connection bar 80 is provided.

The JB-applied pressure welding terminals 50 are electrically connected by the connection bar 80 inserted into the hole of the electrically contacting portion 52 in a state that the pressure welding plate 60 are stacked up. Like this, the electrically contacting portion 52 is connected to another JB-applied pressure welding terminal as another terminal metal fitting.

The engaging piece 58 is provided on each of the sidewalls 56*a*,56*b* by cutting one part thereof. The engaging pieces 58 outwardly project from respective outside surfaces of the sidewalls 56*a*,56*b*. The engaging piece 58 is inclined from one end portion to the other end portion as shown in FIG. 1. The other end of the engaging piece 58 engages an inner surface of a later described partition wall 63*b* when the JB-applied pressure welding terminal 50 is mounted on the pressure welding plate 60.

The slit portion 59 is cut out on the wire connecting portion 51, while extending from a portion R (FIG. 1) to one of the pair of sidewalls 56*a*,56*b*. Here, the portion R is a connecting portion of the electrically contacting portion 52 and the wire connecting portion 51. In the present embodiment, the slit portion 59 extends over the sidewall 56*b* which is located farther from the electrically contacting portion 52.

The slit portion 59 has a first slit portion 59*a* and a second slit 59*b*. The first slit 59*a* is cut out on the placing wall 55 from the above connecting portion R toward the sidewall 56*b* located farther from the electrically contacting portion 52. The first slit 59*a* extends in a width direction of the placing wall 55 from one side thereof toward the other side.

The second slit 59*b* extends from the first slit 59*a* up to the vertical middle portion of the sidewall 56*b*.

The wire connecting portion 51 of the JB-applied pressure welding terminal 50, as shown in FIG. 6, is accommodated in a groove main 61*a* of a later-described electric wire accommodating groove 61 of the pressure welding plate 60, and the electrically contacting portion 52 is accommodated in a later-described accommodating portion 64 of the electric wire accommodating groove 61. When the JB-applied pressure welding terminal 50 is pressed into the groove main 61*a* and the accommodating portion 64, the engaging pieces 58 are inwardly pressed each other.

The electrically contacting portion 52 is capable of shifting relatively to the wire connecting portion 51 in arrow-directions H1,H2 (FIGS. 1,6) owing to the slit portion 59.

When the electrically contacting portion 52 is displaced with respect to the wire connecting portion 51 relatively, mainly the portions V1,V2 (FIG. 1) are elastically or plastically deformed. Here, the portion V1 is located above the top end of the second slit 59*b*. The portion V2 is a bent portion.

The pressure welding plate 60 is formed of insulative synthetic resin tabularly. The pressure welding plate 60 has the rectangular plate body 62, the electric wire accommodating grooves 61, and the through holes 70 as shown in FIGS. 3 to 6. The plate body 62 has a generally flat bottom wall 63*a*, a rear wall 65, a pair of sidewalls 67, partition walls 63*b* upstanding from the bottom wall 63*a*, and a flange portion 68.

The rear wall 65 continues to one rim portion of the bottom wall 63*a*. The rear wall 65 is arranged on the bottom wall 63*a*. The pair of sidewalls 67 continue to the above rear wall 65 on the bottom wall 63*a*. The sidewalls 67 stand on the bottom wall 63*a*. The sidewalls 67 are arranged in parallel.

The flange portion 68 projects outward from the rim of the above bottom wall 63*a*. The flange portion 68 is provided over the whole periphery of the bottom wall 63*a*. The flange portion 68 prevents the plate body 62 from being bent by enhancing the rigidity of the plate body 62.

A portion surrounded by the bottom wall 63*a* and a pair of partition walls 63*b* forms the electric wire accommodating groove 61. The electric wire accommodating groove 61 has the accommodating portion 64 and the groove main 61*a* as shown in FIG. 6. The groove main 61*a* is formed by inside surfaces of the partition walls 63*b* and the bottom wall 53*a*. The groove main 61*a* extends along the above sidewalls 67 and the partition wall 63*b*. The groove main 61*a* accommodates the wire connecting portion 51 of the JB-applied pressure welding terminal 50*a*.

The accommodating portion 64 is formed as a horizontal recess from the side surface of the above partition wall 63*b*. A plurality of accommodating portions 64 are provided on each partition wall 63*b* as shown in FIG. 6. The accommodating portion 64 accommodates the electrically contacting portion 52 of the JB-applied pressure welding terminal 50.

The through hole 70 is provided on each accommodating portion 64. The through hole 70 is bored through the bottom wall 63*a* of the plate body 62.

And, the above pressure welding plate 60 has engaging projections 66 and non-shown engaged projections which engage each other, whereby the pressure welding plates 60 are fixed to each other in forming the laminated plate connector 1. On the pressure welding plate 60, the JB-applied pressure welding terminal 50 are arranged in a matrix.

When the laminated plate connector 1 is assembled, the JB-applied pressure welding terminal 50 is mounted on the pressure welding plate 60 first. At this time, the JB-applied pressure welding terminal 50 is brought close to the bottom wall 63*b* along the above arrow S and mounted on the plate body 62. The JB-applied pressure welding terminal 50 is accommodated in the electric wire accommodating groove 61 as shown in FIG. 6 and fixed to the pressure welding plate 60 by the engaging pieces 58 engaging the inner surfaces of the partition walls 63*b*.

Figure 4:
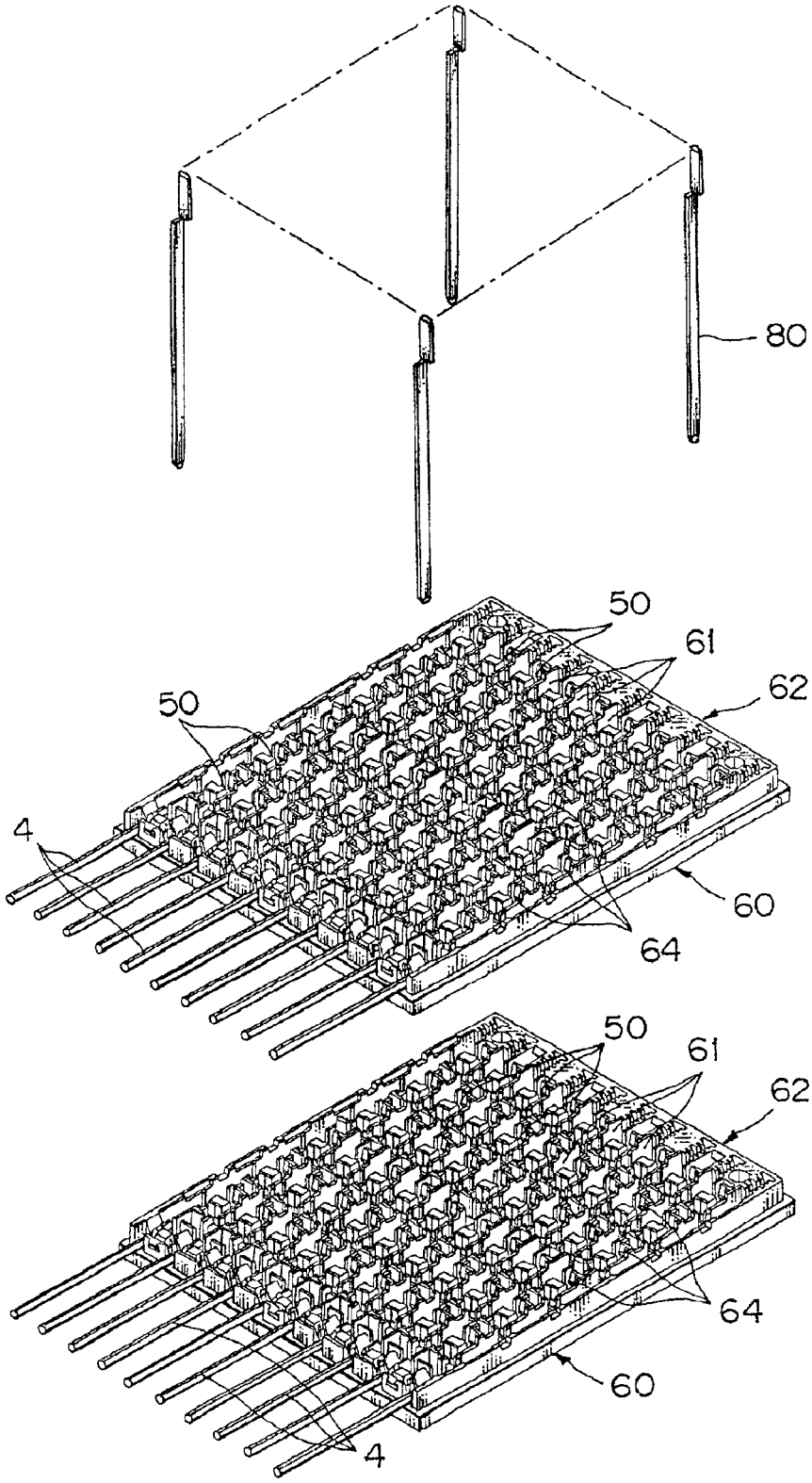
FIG. 4 is a perspective view showing a state of the pressure welding plates to be stacked with an interval.
Figure 5:
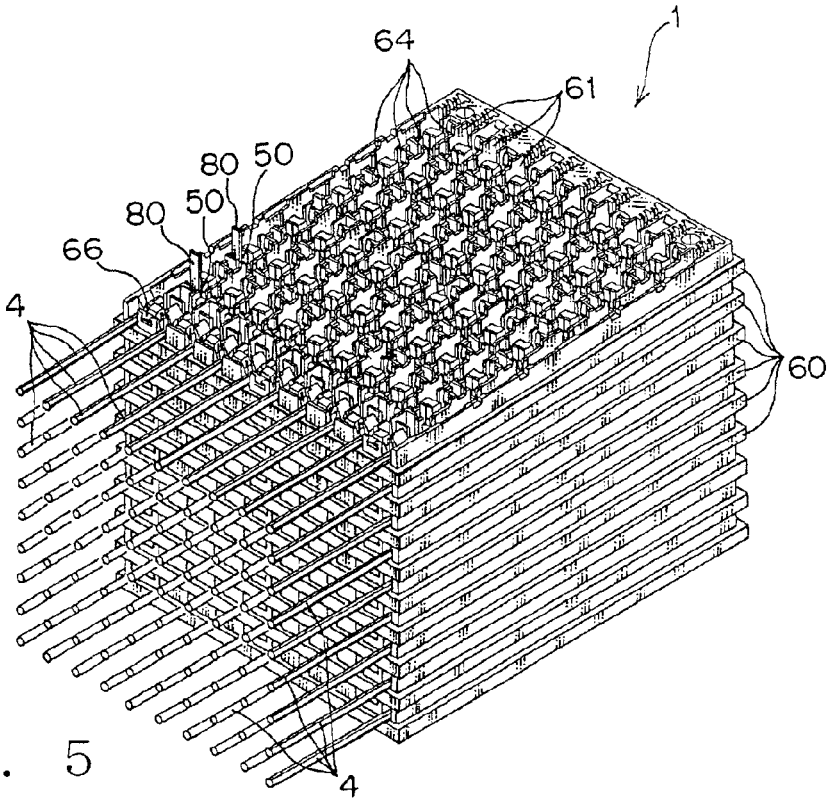
FIG. 5 is a perspective view showing a laminated plate connector obtained by fixing the pressure welding plates.

And, the electric wire 4 is pressure-welded to the JB-applied pressure welding terminal 50 accommodated in the groove main 61*a* and the accommodating portion 64. At this time, the electric wire 4 is pressed between the pressure welding edges 54*a*,54*b* of the wire connecting portion 51 along the above arrow S. In this state, the pressure welding plates 60 are stacked up as shown in FIG. 4 in parallel. And, the pressure welding plates 60 are brought close to each other till the engaging projections 66 engage the engaged projections. The pressure welding plates 60 form the laminated plate connector 1 shown in FIG. 5 by inserting the connection bars 80 into the through holes 70 and the electrically contacting portions 52.

In the laminated plate connector 1, the electric wires 4 to be pressure-welded to the respective JB-applied pressure welding terminals 50 are connected in a predetermined pattern according to the arrangement of the JB-applied pressure welding terminals 50 and the connection bars 80. And, the above laminated plate connector 1 is accommodated in an electric junction box mounting, for example, relays, fuses and the like and connects the relays and the fuses with the above electric wire 4 in a predetermined pattern.

Figure 7A:
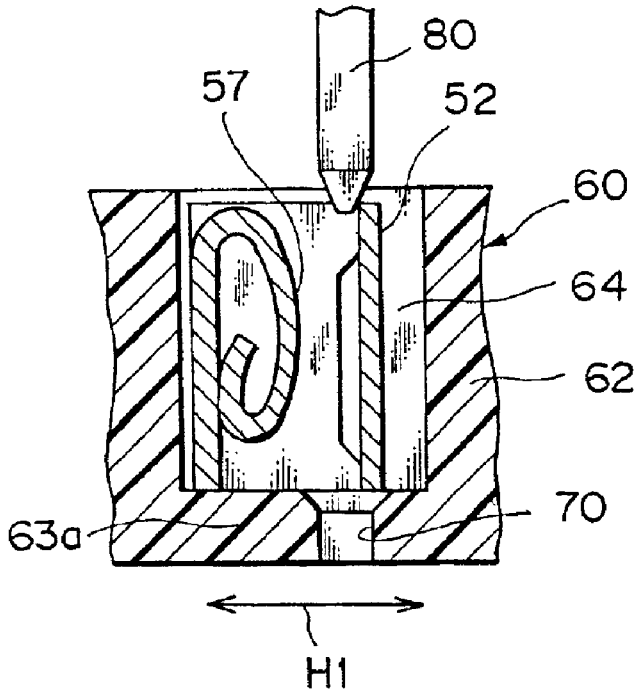
FIG. 7A is a sectional view showing a state of a hole of the electrically contacting portion deviating from the through hole in an arrow H1 direction.

According to the present embodiment, the electrically contacting portion 52 of the JB-applied pressure welding terminal 50 shifts with respect to the wire connecting portion 51 in the directions H1,H2 even when the JB-applied pressure welding terminal 50 is accommodated in the electric wire accommodating groove 61. Meanwhile, the electrically contacting portion 52 would be likely to deviate from the through hole 70 in the H1 and/or H2 direction as shown in FIG. 7A and/or 8A due to a manufacturing dimensional error.

Figure 7B:
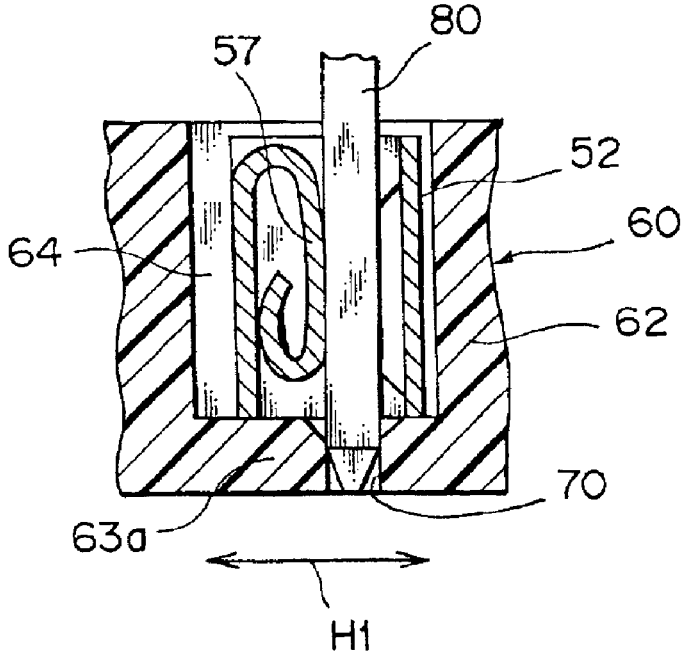
FIG. 7B is a sectional view showing a state of a hole of the electrically contacting portion agreeing with the through hole after the electrically contacting portion shifts in the arrow H1 direction.
Figure 8A:
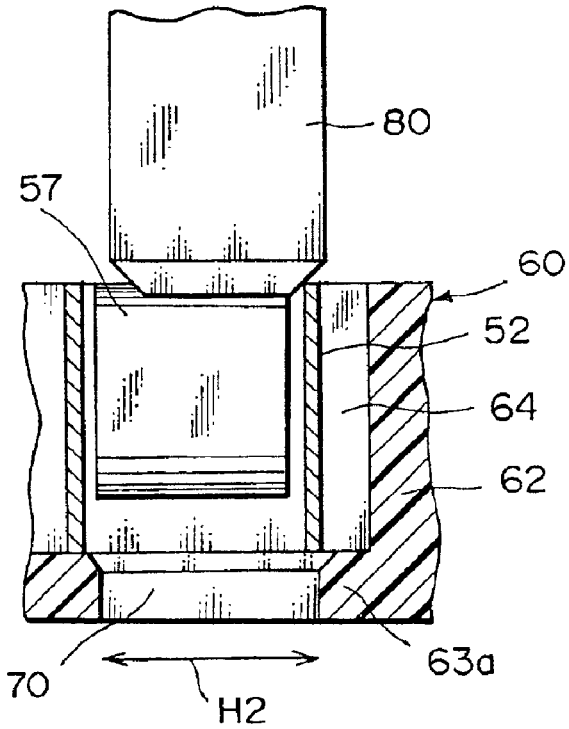
FIG. 8A is a sectional view showing a state of a hole of the electrically contacting portion deviating from the through hole in an arrow H2 direction.
Figure 8B:
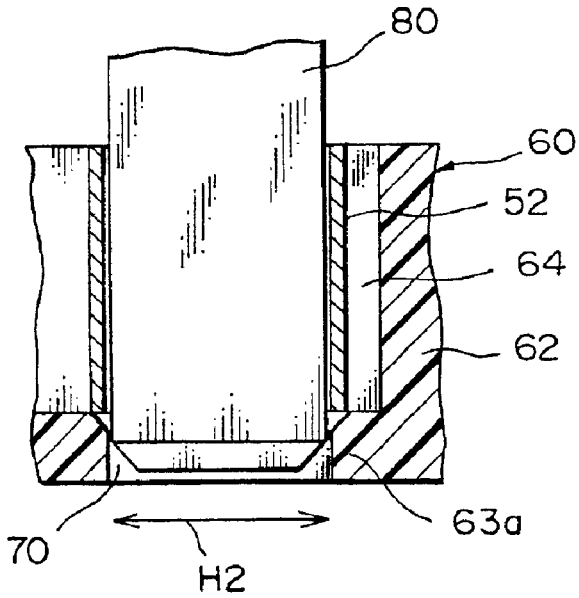
FIG. 8B is a sectional view showing a state of a hole of the electrically contacting portion agreeing with the through hole after the electrically contacting portion shifts in the arrow H2 direction.

However, when the connection bar 80 is inserted into the hole of the electrically contacting portion 52, the electrically contacting portion 52 shifts in the H1 and/or H2 direction toward a position where the hole of the electrically contacting portion 52 agrees with the through hole 70 as shown in FIG. 7B and/or 8B.

Like this, because the electrically contacting portion 52 of the JB-applied pressure welding terminal 50 can shifts with respect to the wire connecting portion 51 in the directions H1,H2 by means of the slit portion 59, even if the hole of the electrically contacting portion 52 deviates from the through hole 70, the electrically contacting portion 52 shifts toward the position where the hole agrees with the through hole 70 by the insertion of the connection bar 80. Accordingly, the connection bar 80 can also be easily inserted into the electrically contacting portion 52.

And, because the electrically contacting portion 52 can shift with respect to the wire connecting portion 51 in the directions H1,H2, an excessive stress in the JB-applied pressure welding terminal 50 can be prevented when the connection bar 80 is inserted into the electrically contacting portion 52. Therefore, a break of the JB-applied pressure welding terminal 50 at the connecting portion R can be prevented.

Therefore, the JB-applied pressure welding terminals in the stacked pressure welding plates 60 enable the stacked electrically contacting portions 52 to be securely electrically connected each other, thereby ensuring a secure connection of the electrically contacting portions 52 with the electric wires 4. And, because the slit portion 59 has the first slit 59*a* and the second slit 59*b*, the electrically contacting portion 52 can securely shift with respect to the wire connecting portion 51.

Figure 9:
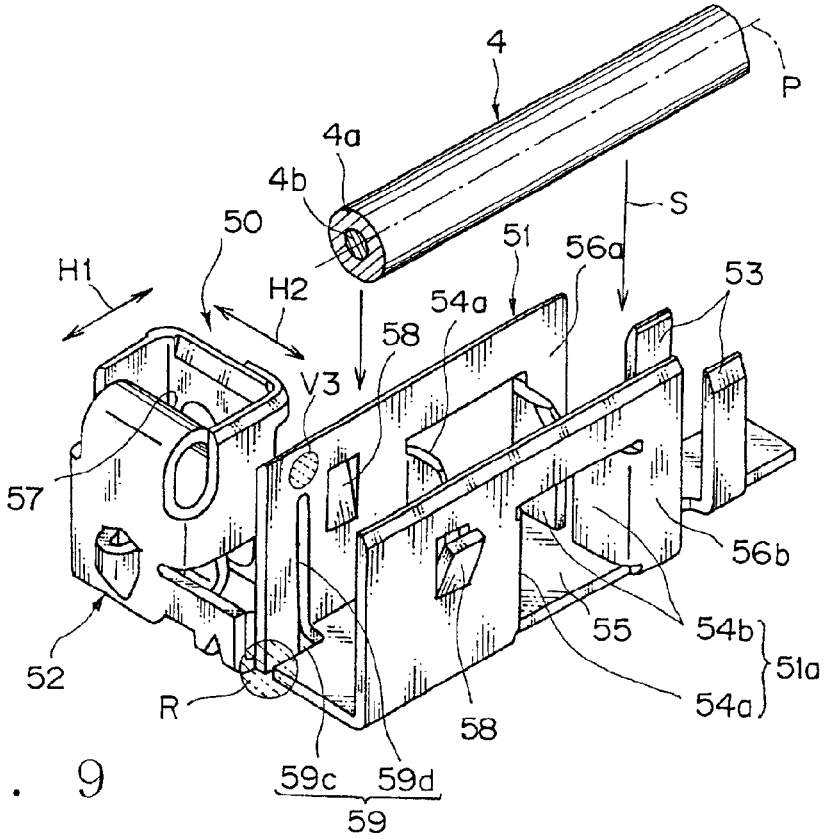
FIG. 9 is a perspective view showing a second embodiment of the JB-applied pressure welding terminal in accordance with the present invention.
Figure 10:
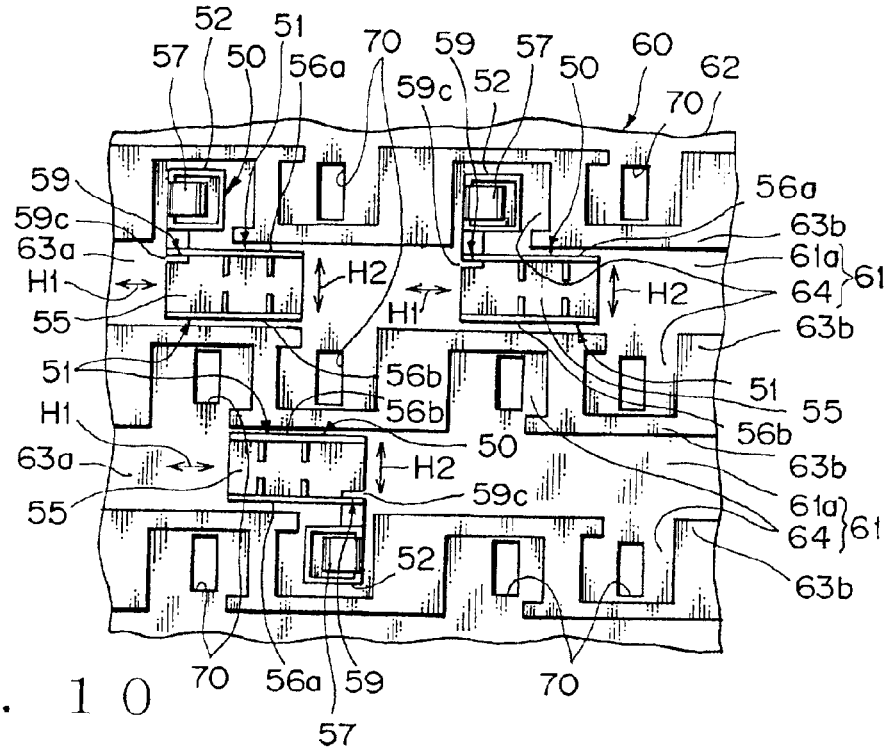
FIG. 10 is a plan view showing a state of the pressure welding plate and the JB-applied pressure welding terminals, of FIG. 9, mounted thereon.

Next, a second embodiment of a pressure welding terminal for a plate connector, i.e., a pressure welding terminal 50 for a junction block (JB), in accordance with the present invention is described by referring to FIGS. 9 and 10. Hereinafter, the same character is applied to the same element as that of the first embodiment, and its description is omitted.

In the present embodiment, the slit portion 59 shown in FIG. 9 is provided on the wire connecting portion 51 from the connecting portion R toward the sidewall 56*a* nearer the electrically contacting portion 52. The third slit portion 59 has a third slit 59*c* and a fourth slit 59*d*.

That is, the third slit 59*c* is provided on the placing wall 55 from its one side nearer the electrically contacting portion 52 along the longitudinal axis P of the electric wire 4 as shown in FIG. 9 and FIG. 10.

The fourth slit 59*d* upwardly extends from the third slit 59*c* to the vertical middle portion of the sidewall 56*a*.

In the present embodiment, the electrically contacting portion 52 can shift in the directions H1,H2 with respect to the wire connecting portion 51 by means of the slit portion 59 having the third and fourth slits 59*c*,59*d*. And, when the electrically contacting portion 52 shifts with respect to the wire connecting portion 51, mainly a portion. V3 is elastically or plastically deformed.

The JB-applied pressure welding terminal 50 of the present embodiment is pressed between the neighboring partition walls 63*b* as shown in FIG. 10 and is accommodated in the electric wire accommodating groove 61. At this time, the engaging pieces 58 engage the inner surfaces of the partition walls 63*b*, while the JB-applied pressure welding terminal 50 is mounted on the pressure welding plate 60.

According to the present embodiment, similarly to the first embodiment, because the electrically contacting portion 52 of the JB-applied pressure welding terminal 50 can shifts with respect to the wire connecting portion 51 in the directions H1,H2 by means of the slit portion 59, even if the hole of the electrically contacting portion 52 deviates from the through hole 70, the electrically contacting portion 52 shifts toward the position where the hole agrees with the through hole 70 by the insertion of the connection bar 80. Accordingly, the connection bar 80 can also be easily inserted into the electrically contacting portion 52.

And, because the electrically contacting portion 52 can shift with respect to the wire connecting portion 51 in the directions H1,H2, an excessive stress in the JB-applied pressure welding terminal 50 can be prevented when the connection bar 80 is inserted into the electrically contacting portion 52. Therefore, a break of the JB-applied pressure welding terminal 50 at the connecting portion R can be prevented.

Therefore, the JB-applied pressure welding terminals in the stacked pressure welding plates 60 enable the stacked electrically contacting portions 52 to be securely electrically connected each other, thereby ensuring a secure connection of the electrically contacting portions 52 with the electric wires 4. And, because the slit portion 59 has the third slit 59*c* and the fourth slit 59*d*, the electrically contacting portion 52 can securely shift with respect to the wire connecting portion 51.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A pressure welding terminal (50) for a plate connector, comprising:

a wire connecting portion (51) for pressure welding an electric wire having a pair of walls (56*a*, 56*b*) between which the electric wire is accommodated;

an electrically contacting portion (52) having a tubular shape, and being connected with the wire connecting portion (51) by a connecting portion, into which a connection bar (80) is inserted for electrically connecting the electrically contacting portion (52) with another pressure welding terminal (50); and a slit portion (59) provided between the wire connecting portion (51) and the electrically contacting portion (52), and extending from a placing wall (55) to one of the pair of walls, wherein the wire connecting portion (51) and the electrically contacting portion (52) are arranged integrally in an L-shape in a plane view, and mounted on an insulating plate body of the plate connector in a manner that the wire connecting portion (51) is communicated with a communicating hole of the insulating plate body, wherein said one of the pair of walls to which the slit portion (59) is a cut through extended in a width direction of the wall (56*b*) which is positioned further from the electrically portion (52) than the other wall (56*a*).

2. The pressure welding terminal (50) for the plate connector as claimed in claim 1, wherein the wire connecting portion has the placing wall (55) from which the pair of walls (56*a*, 56*b*) extend and on which the electric wire is placed, and the slit portion (59) has a first slit (59*a*) cut out on the placing wall (55) in a width direction of the placing wall and a second slit (59B) cut out on the wall (56*b*) further from the electrically contacting portion (52) than the wall (56*a*) in a direction of pressing the electric wire for pressure welding.

3. A pressure welding terminal (50) for a plate connector, comprising:

a wire connecting portion (51) for pressure welding an electric wire having a pair of walls (56*a*, 56*b*) between which the electric wire is accommodated;

an electrically contacting portion (52) having a tubular shape, and being connected with the wire connecting portion (51) by a connecting portion, into which a connection bar (80) is inserted for electrically connecting the electrically contacting portion (52) with another pressure welding terminal (50); and a slit portion (59) provided between the wire connecting portion (51) and the electrically contacting portion (52), and extending from a placing wall (55) to one of the pair of walls, wherein the wire connecting portion (51) and the electrically contacting portion (52) are arranged integrally in a L-shape in a plane view, and mounted on an insulating plate body of the plate connector in a manner that the wire connecting portion (51) is communicated with a communicating hole of the insulating plate body, wherein said one of the pair of walls to which the slit portion (59) is a cut through extended in a width direction of the wall (56*a*) which is positioned nearer from the electrically portion (52) than the other wall (56*b*).

4. The pressure welding terminal (50) for the plate connector as claimed in claim 3, wherein the wire connecting portion (51) has the placing wall (55) from which the pair of walls (54*a*, 54*b*) extend and on which the electric wire is placed, and the slit portion (59) has a third slit (59*c*) cut out on the placing wall in a longitudinal direction of the electric wire, and a fourth slit cut out on the wall (56*a*) nearer the electrically contacting portion (52) than the wall (56*b*), and continuing from the third slit in a direction of pressing the electric wire for pressure welding.

* * * * *